United States Patent [19]

Voegele

[11] 4,077,186

[45] Mar. 7, 1978

[54] METHOD AND APPARATUS FOR MAKING PACKAGES

[75] Inventor: Guenther Voegele, Schonaich, Germany

[73] Assignee: Robert Bosch GmbH, Stuttgart, Germany

[21] Appl. No.: 745,144

[22] Filed: Nov. 26, 1976

[30] Foreign Application Priority Data

Nov. 29, 1975 Germany ..... 2553854

[51] Int. Cl.[2] ..... B65B 9/12

[52] U.S. Cl. ..... 53/28; 53/180 M; 53/183

[58] Field of Search ..... 53/28, 29, 180 R, 180 M, 53/182 M, 183, 386

[56] References Cited

U.S. PATENT DOCUMENTS

| | | | |
|---|---|---|---|
| 3,314,215 | 4/1967 | Alfred | 53/182 M |
| 3,789,569 | 2/1974 | Eggar | 53/180 R |

FOREIGN PATENT DOCUMENTS

| | | | |
|---|---|---|---|
| 2,321,538 | 1/1975 | Germany | 53/180 M |
| 915,519 | 1/1963 | United Kingdom | 53/28 |

*Primary Examiner*—Robert Louis Spruill
*Attorney, Agent, or Firm*—Edwin E. Greigg

[57] ABSTRACT

A method and a machine for continuous production of liquid-filled packages employs a series of transverse welding mechanisms for making seams across a hose-like material. Thus, pockets are formed into which liquid material is introduced somewhat in excess of the desired nominal amount. The over-filled pocket is then moved to a squeezing station where pressure is applied to force part of the liquid back out of the pocket into the next following pocket and where the pocket is shaped into the final package. When the desired final shape and volume are reached, the upper seam is completely welded, thus closing the package which is then severed from the hose.

8 Claims, 2 Drawing Figures

METHOD AND APPARATUS FOR MAKING PACKAGES

BACKGROUND OF THE INVENTION

The invention relates to a method and an apparatus for producing packages with liquid contents. More particularly, the method and apparatus of the invention relate to the production of packages from a continuous hose-like material with two continuous parallel walls and two lateral V-shaped folds. By performing transverse sealing operations at regular intervals, the hose-like material is subdivided into sections after which a certain amount of content is introduced into the newly formed section and is completely sealed and severed from the material.

In a method of this type fluid is introduced into the container through a filling tube extending into the container in between upper and lower transverse seams. Subsequently the container is completely sealed on top. This method requires relatively considerable time for the production of a package. Furthermore, the precision of filling is not very great because the package is free to bulge without limits.

OBJECT AND SUMMARY OF THE INVENTION

It is an object of the invention to provide a method and an apparatus for performing the method of producing filled, air-free packages, the contents of which are precisely dosaged and which results in a great increase in productivity and capacity.

This and other objects are attained according to the invention by providing that the liquid contents are continuously introduced into the hose-like material up to a given level lying above the location at which the final upper transverse seam of the package will be produced. Prior to seam, completion of the upper transverse sseam, at least portions of the wall lying between the upper and lower seams are grasped and the walls are expanded up to a certain distance. During this step, fluid flows through the channel in the incomplete top seam into the hose region below.

A particularly great increase of productivity and a very high degree of filling precision is obtained by providing that a first station of the apparatus has means for spreading the walls of the partially completed container so as to be filled with a quantity of liquid slightly larger than the nominal contents of the package. In a further, second station, a light squeezing of the walls of the container causes the excess quantity to be pushed back into the subsequent hose region through the channel still open in the upper lateral seam. Thereafter, the upper seam is completely closed.

The apparatus to carry out the method of the invention includes means for applying transverse seams in the hose material, in particular to make a seam the center of which is unsealed so that liquid goods may be introduced into the hose. The apparatus then further includes means for completing the transverse seams and gripper means associated with opposite walls of the hose which spread the walls of the hose apart so that liquid goods may flow through the channel in the incomplete upper seam into the container.

The invention will be better understood as well as other objects and advantages thereof become more apparent from the following detailed description of a preferred embodiment taken in conjunction with the single figure of the drawing.

DESCRIPTION OF THE PREFERRED EMBODIMENT

Figure 1:
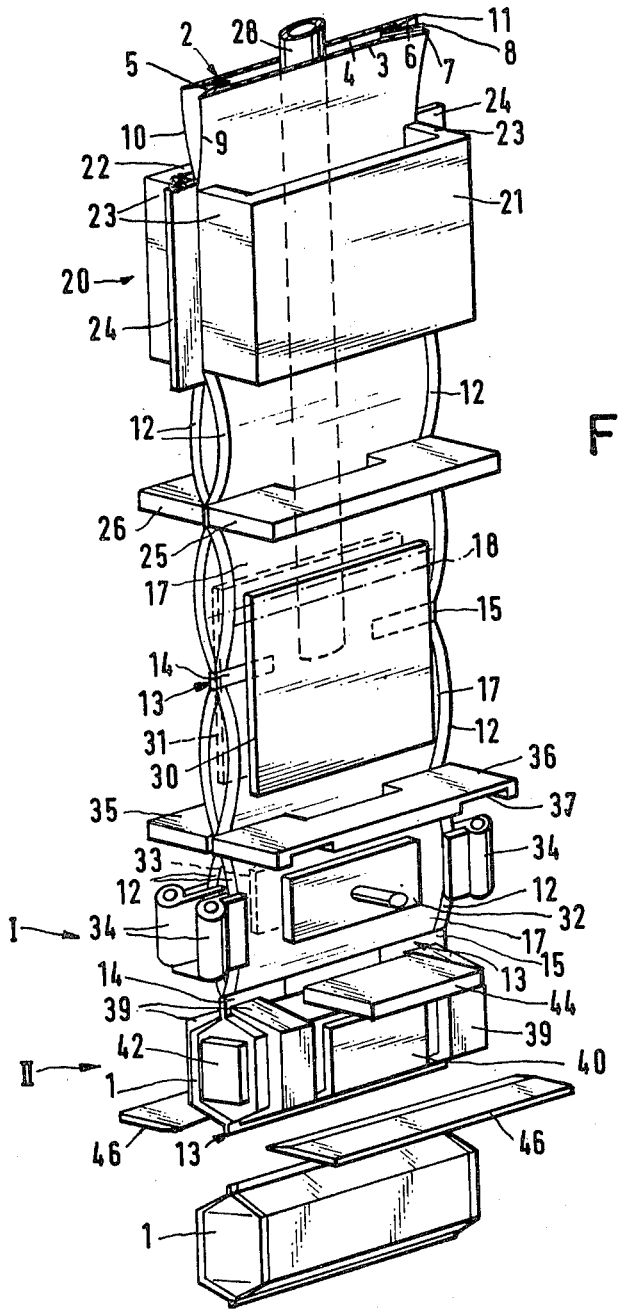
FIG. 1 is a perspective, exploded, front elevational view of a package making and filling machine according to the invention.
Figure 2:
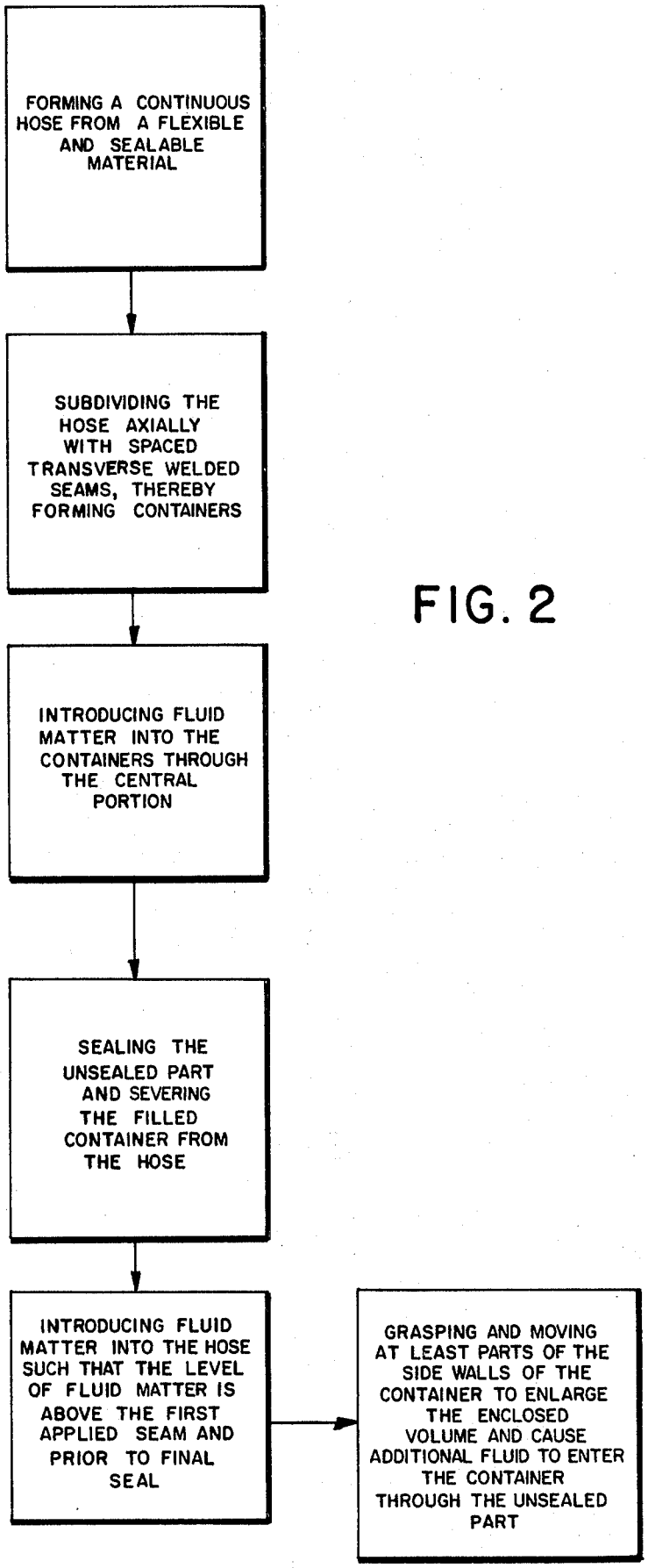
FIG. 2 is a flow chart illustrating a preferred set of steps for performing the process according to the invention.

Turning now to FIG. 1, there is illustrated an apparatus which receives a hose-like web 2 admitted at the top and coming from a supply station (not illustrated). The hose 2 has two parallel continuous walls 3, 4 and two lateral continuous folds 5, 6. Preferably, the material is a cardboard plastic composite or an aluminum plastic composite which can be welded. The hose 2 may be formed from a single web or from two or four webs whose edges are sealed together. In the illustrated preferred exemplary embodiment, the hose 2 is formed from a single web whose edges 7, 8 and whose folds 9, 10, 11 are sealed at the point of transition from the parallel walls 3, 4 to the lateral folds 5, 6 by edge welding seams 12 performed by an axial welder 20. The axial welder includes two oppositely movable plates 21, 22 each having two welding bars 23 whose width corresponds to that of the parallel walls 3, 4 of the hose 2. Where the two welding bars 23 meet, separator plates 24 extend between the two plies of the lateral folds 5, 6 so that while the edge seams 12 are being welded, the plies of the lateral folds are not joined.

The vertically guided hose 2 is transported in steps in a downward direction through a distance required for the production of a package 1. For this purpose, the plates 21, 22 and the separator plates 24 can be raised and lowered by this particular length so that they pull the hose downwardly during the application of pressure and heat.

Mounted below the lowermost position of the plates 21, 22 is a pair of transverse welding jaws 25, 26, each having a central recess so that when the jaws press together they generate only the external parts 14, 15 of a complete transverse seam 13, thereby welding the lateral folds 5, 6 to the parallel walls 3, 4 and also welding together adjacent portions of the walls 3, 4. If the outside of the material is capable of accepting welds, the adjacent plies of the side folds 5, 6 are welded together in those portions lying in the transverse seams 14, 15. After each downward migration of the hose 2, transverse seam portions 14, 15 are applied so that the entire hose is thereby subdivided into regions 17.

Extending into the laterally still open hose 2 is a filling tube 28 which proceeds through the center of the closed hose 2 in a downward direction and passes through the recessed center of the transverse welding jaws 25, 26 and through the unwelded portion between the welded seams 14, 15. This filling tube 28 continuously supplies preferably liquid material as contents into the lower end of the hose so that a column of fluid is formed having a level 18 which is located in the hose region 17 lying beneath the transverse welding jaws 25, 26. Two parallel and locally fixed limiter walls 30, 31 make contact with the walls 3, 4 of the hose 2 and prevent excessive and uncontrolled bulging of the hose region 17 due to internal pressure of the liquid in the upper portion of the liquid column.

For the purpose of complete formation of the hose region 17 and to provide the final packaging shape, as well as for the dosaging of the contents, there are provided beneath the limiting walls 30, 31 two operational stations I and II. The upper station I forms a hose region 17 into a package 1 at the same time as it performs a coarse dosaging of the contents including a slight excess of the contents. The lower station II forces the excess contents back into the upwardly adjacent hose region 17 and completes the welding of the upper transverse seam 13.

For this purpose, the upper station I includes a pair of suction plates 32, 33 associated with the walls 3, 4 of the hose 2 as well as four pincers 34 for grasping the edge seams 12 and a pair of guide jaws 35, 36. Toward the end of the transport step of the hose 2 and the connected hose region 17, the guide jaws 35, 36 which also have a recess in the center in the same manner as the transverse welding jaws 25, 26 move up to the upper transverse seam portions 14, 15 of the hose region 17 located in the upper station I, where they grasp the hose 2 and guide it downwardly by a distance equal to the distance by which a hose region 17 is shortened when a final prismatic package 1 is formed. At the same time, the suction plates 32, 33 first move up to the somewhat bulging walls 3, 4, grasp it by suction and pull it outwardly by a predetermined amount at the same time as performing a downward motion through a distance equal to approximately one half of the shortening of the hose region. At the same time, the pincers 34 move transversely to the motion of the suction plates 32, 33 and grasp the edge seams 12 at the same time as forcing them apart in the same measure as the walls 3, 4 are moved by the suction plates 32, 33. At the same time, they also experience a downward motion. The height of the suction plates 32, 33 and that of the pincers 34 is approximately equal to one-half of the length of a hose region. These elements grasp the walls 3, 4 and the edge seams 12 in the center of the hose region so that, after the container is enlarged, the cross section in the ends will have the shape of a hexagon whose plane of symmetry passes through the lateral seams 13. When the hose region 17 is enlarged in the station I, the liquid contents flow from the above-lying region 17 through the channel formed between the welded seam portions 14, 15 into the hose region 17 present in the station I. When the hose region 17 is formed into a prismatic package 1 having a hexagonal cross section, this package attains a predetermined volume. This volume is so adjusted as to be approximately 5% greater than the nominal volume of the package.

The package I thus formed and filled is then transported into the lower station II. This is accomplished by two pairs of U-shaped claws 39 which travel through a distance equal to the height of of package. The pairs of claws 39 grasp the package in the lateral areas lying between the pincers 34 and the suction plates 32, 33. The width of the claws 39 is equal to the width of the space between the pincers and the suction plates. The interior shape of each pair of claws is adapted to the external shape of a completed package 1. Toward the end of the process of forming the hose region 17 into a package 1 in the upper station I, the pairs of claws 39 grasp the package 1 and the pressure surfaces at the ends of the free legs take hold of the edge regions of the welded seam portions 14, 15 in both the upper and lower seams. In order to permit this engagement at the upper transverse seam portions 14, 15, the guide jaws 35, 36 have appropriate recesses at the bottom.

When the guide jaws 35, 36 and the pincers 34 have been moved away from the package 1 and after the suction has been turned off in the suction plates 32, the claws 39 hold and guide the package 1 by a distance equal to the height of the package 1 toward the station II. At the same time, of course, the hose 2 is transported downwardly by the length of a hose region 17. While the package 1 is held in station II by claws 39, two angled dosage plates are advanced to within a predetermined distance while two flat dies 42 are also advanced against the walls formed by the side folds 5, 6. At the same time, the jaws 44 of a second seam welder are moved together against the incomplete portion of the upper athwart seam 13 of the package 1. All these elements together substantially define a chamber containing a yet incompletely sealed package 1 whose volume is equal to the nominal volume of the final package. When the enclosed package 1 is thus compressed into its final desired shape, which however is sustantially similar to the shape it has attained in station I, the previously admitted excess fluid is now forced back through the channel still existing between the welded seam portions 14, 15 into the subsequent hose region 17. Thus, the package 1 obtains the final exact dosaging of its nominal contents. In the final phase of the mutual approach of the second welder bars 44, the as yet incomplete portion of the transverse seam 13 between the welded seam portions 14, 15 is compressed and also welded.

While the second welding jaws 44 are pressed against the transverse seam 13, the claws 39 release the package and return to the station I. At the same time, the dosage plates 40 and the dies 42 are also retracted. Furthermore, shortly after the onset of pressure of the transverse welding jaws 44, the guide jaws 35, 36 are pressed against the transverse seam portions 14, 15 and the hose region 17 introduced into station I is enlarged and preformed.

After the second welding jaws 44 have performed their seal and are retracted from the finished seam 13, and after a further package has been preformed in station I a new conveyor step is executed in which, as already described, the hose region 17 and the finished package are transported downwardly by another step so that the upper transverse seam 13 of the lowermost package I comes to lie in the effective area of a shear 46. The shear 46 cuts the welded seam 13 centrally along its length so that the finished and filled package I falls downwardly to a discharge point (not illustrated).

It is noted that the transport of the hose 2 may be performed by separately driven conveyor means. In that case, the axial welder mechanism may be locally fixed.

It is to be especially noted with respect to the illustrated embodiment that the separation of the functions of shaping the package and final dosaging of the contents in two separate steps results in a particularly precise filling and in a very high productivity.

The foregoing relates to a preferred exemplary embodiment of the invention, it being understood that other variants and embodiments thereof are possible within the spirit and scope of the invention, the latter being defined by the appended claims.

What is claimed is:

1. In a method for making packages for fluid contents, said method including the step of forming a continuous hose from a flexible and sealable material, said hose having two continuous parallel main walls and two side walls folded inwardly in the manner of a V, the further step of subdividing said hose axially with spaced transverse welded seams, thereby forming containers, each seam being applied firstly over only a portion of said hose, leaving an unsealed part, the further step of introducing fluid matter into said containers through said central portion, the step of sealing said unsealed part and severing the filled container from said hose, the improvement comprising the step of:

introducing fluid matter into said hose such that the level of fluid matter is above said firstly applied seam; and, prior to final sealing, grasping and moving at least parts of the side walls of said container to thereby enlarge the enclosed volume and cause additional fluid to enter said container through said unsealed part.

2. A method as defined by claim 1, including the further step of grasping and spreading portions of said main walls which are congruent with said side walls.

3. A method as defined in claim 1, the improvement further comprising:

performing the step of grasping and moving at least parts of the side walls of said container in such a way that the fluid volume in said container is somewhat in excess of nominal fluid volume of the finished and sealed package; thereafter moving said main walls toward each other to thereby force said excess fluid quantity through said unsealed part back into the succeeding container in said hose; and thereafter performing the step of sealing said unsealed part.

4. In a machine for making packages for fluid contents, said machine including means for transporting a flexible continuous hose having parallel main walls and inwardly folded side walls, and including means for applying to said hose a first transverse welded seam to partially join opposing portions of said main walls while leaving a channel, and further including means to complete said first transverse welded seam to thereby form a continuous seam across said hose, and means for passing fluid through said channel into the container defined in said hose by a previously made continuous seam, the improvement comprising:

expander means for moving opposite portions of said main walls away from one another to thereby cause an increase of the volume of said container; whereby fluid is admitted into said container through said channel.

5. A machine as defined in claim 4, further comprising:

dosaging means, located downwardly of said means to complete said transverse seams, for simultaneously moving said main walls toward one another and for moving said side walls toward one another; whereby fluid is forced from said container through said channel into the succeeding portion of said hose.

6. A machine as defined in claim 5, the improvement further comprising:

conveyor means, for grasping said container by edge portions of said seam and for moving it from the location where said expander means operate to the location where said dosaging means operate.

7. A machine as defined in claim 6, wherein said conveyor means are pincers which engage edges of said container formed by the junction of said main walls and said side walls.

8. A machine as defined in claim 4, wherein said expander means are suction operated devices.

* * * * *